US007731595B2

(12) United States Patent
Hlynka

(10) Patent No.: US 7,731,595 B2
(45) Date of Patent: Jun. 8, 2010

(54) WATERSLIDE AMUSEMENT DEVICE

(75) Inventor: Marvin R Hlynka, Richmond (CA)

(73) Assignee: White Water West Industries, Ltd., British Columbia (CA)

( * ) Notice: Subject to any disclaimer, the term of this patent is extended or adjusted under 35 U.S.C. 154(b) by 825 days.

(21) Appl. No.: 10/986,678

(22) Filed: Nov. 12, 2004

(65) Prior Publication Data

US 2005/0282643 A1 Dec. 22, 2005

Related U.S. Application Data

(63) Continuation-in-part of application No. 10/782,517, filed on Feb. 18, 2004, now Pat. No. 6,945,873, which is a continuation of application No. 10/299,585, filed on Nov. 18, 2002, now Pat. No. 6,729,963.

(60) Provisional application No. 60/334,474, filed on Nov. 16, 2001, provisional application No. 60/576,720, filed on Jun. 2, 2004.

(51) Int. Cl.
*A63G 21/18* (2006.01)
*A63G 31/00* (2006.01)

(52) U.S. Cl. ..... 472/117; 472/128

(58) Field of Classification Search ..... 472/116, 472/117, 128, 129, 13
See application file for complete search history.

(56) References Cited

U.S. PATENT DOCUMENTS

| | | | | |
|---|---|---|---|---|
| 654,980 | A | 7/1900 | Howard | |
| 831,149 | A * | 9/1906 | Faller | 104/70 |
| 2,724,123 | A | 11/1955 | Kesler | |
| 4,149,710 | A | 4/1979 | Rouchard | |
| 4,687,452 | A * | 8/1987 | Hull | 441/131 |
| 4,836,521 | A | 6/1989 | Barber | |
| 5,011,134 | A | 4/1991 | Langford | |
| 5,069,443 | A | 12/1991 | Shiratori | |
| 5,122,086 | A * | 6/1992 | Remy | 441/66 |
| 5,137,497 | A | 8/1992 | Dubeta | |
| 5,167,321 | A * | 12/1992 | Brodrick, Sr. | 198/867.14 |
| 5,213,547 | A | 5/1993 | Lochtefeld | |
| 5,401,117 | A | 3/1995 | Lochtefeld | |
| 5,433,671 | A | 7/1995 | Davis | |
| 5,503,597 | A | 4/1996 | Lochtefeld et al. | |
| 5,667,445 | A | 9/1997 | Lochtefeld | |
| 5,685,778 | A * | 11/1997 | Sheldon et al. | 472/43 |
| 5,704,294 | A * | 1/1998 | Van Winkle et al. | 104/73 |
| 5,716,282 | A | 2/1998 | Ring et al. | |
| 5,738,590 | A | 4/1998 | Lochtefeld | |
| 5,766,082 | A | 6/1998 | Lochtefeld et al. | |

(Continued)

FOREIGN PATENT DOCUMENTS

GB 2224948 A 5/1990

(Continued)

OTHER PUBLICATIONS

"Sidewinder MKII/Typical Plan Layout," Waterfun Products Inc., Sylvan Lake, Alberta, Canada, dated Jan. 28, 1994, 1-page advertising blueprint.

*Primary Examiner*—Kien T Nguyen
(74) *Attorney, Agent, or Firm*—Snell & Wilmer L.L.P.

(57) ABSTRACT

A slide (104) supports and directs a user along a predetermined path. A conveyor system (102) is coupled to the slide to accelerate the user along the predetermined path.

17 Claims, 9 Drawing Sheets

U.S. PATENT DOCUMENTS 6,045,449 A 4/2000 Aragona et al.
6,261,186 B1 7/2001 Henry
6,354,955 B1 3/2002 Stuart et al.
6,450,891 B1 9/2002 Dubeta
6,475,095 B1 11/2002 Henry
6,702,687 B1 3/2004 Henry
6,729,963 B2 5/2004 Hlynka
6,743,107 B2 6/2004 Dubeta
6,758,231 B1 * 7/2004 Lochtefeld et al. ..... 137/1
6,945,873 B2 9/2005 Hlynka
7,285,053 B2 * 10/2007 Henry et al. ..... 472/117

FOREIGN PATENT DOCUMENTS

WO WO 92/11072 A1 7/1992

* cited by examiner

WATERSLIDE AMUSEMENT DEVICE

CROSS-REFERENCE TO RELATED APPLICATION

This application is a continuation-in-part of application Ser. No. 10/782,517, filed Feb. 18, 2004, now U.S. Pat. No. 6,945,873, which is a continuation of application Ser. No. 10/299,585, filed Nov. 18, 2002, now U.S. Pat. No. 6,729,963, which claims the benefit of Provisional Application No. 60/334,474, filed on Nov. 16, 2001; and this application claims the benefit of Provisional Application No. 60/576,720, filed Jun. 2, 2004, the disclosure of which is hereby expressly incorporated by reference herein.

FIELD OF THE INVENTION

The present invention relates to waterslide amusement devices, and more particularly, to waterslide amusement devices operable to accelerate a user.

BACKGROUND OF THE INVENTION

Waterslide amusement devices have been popular for decades. In a typical previously developed waterslide, a rider climbs a stairwell located in a tower. The rider then enters an entrance of the waterslide and is propelled by gravity along the waterslide until splashing into a pool located at an end of the waterslide. Water flows down the waterslide along with the rider to decrease friction and enhance the entertainment value of the ride. However, since the rider is propelled by gravity alone, a long ride requires the construction of a very large and very high tower, and an intricate elevated framework for suspending the waterslide high above the ground. Thus, previously developed gravity based waterslides are expensive to manufacture and construct.

One solution to this problem has been to provide a lift mechanism to lift a rider along the waterslide to a starting height, eliminating the need for the rider to climb stairs to ascend the tower. However, such lift mechanisms add no excitement to the user's experience of the ride. These lift mechanisms convey the rider at a constant speed, about 3 ft/sec, which is slow and unexhilarating to the rider.

Another solution has been to propel the user up an inclined surface using water jets. More specifically, a series of water jets are used to jet high-pressure water up the waterslide, and in the process entrain the rider to propel the rider up the slide. Although effective, this previously developed waterslide has certain serious limitations. If a single jet is used, riders can only be conveyed a short distance as the power of the jet dissipates quickly. Thus, the rider tends to slow down as the rider progresses along the path of the jet. Additionally, if several nozzles are used in series, a rider slows down as he or she travels the path of the jet, and then may be violently jerked along as the rider enters the slipstream of the next jet.

SUMMARY OF THE INVENTION

One embodiment of an amusement device formed in accordance with the present invention for entertaining a user includes a slide for supporting and directing the user along a predetermined path. The waterslide amusement device further includes a conveyor system coupled to the slide. The conveyor system has a conveyor belt interfaced with the slide, the conveyor belt being operable to accelerate the user along the predetermined path.

In an alternate embodiment, the conveyor system includes a first conveyor belt disposed along the predetermined path for supporting the user and accelerating the user from an entrance speed measured at an entrance of the first conveyor belt to a higher exit speed measured at an exit of the first conveyor belt. The conveyor system also includes a second conveyor belt disposed along the predetermined path for supporting the user and for transporting the user from a first elevation measured at an entrance of the second conveyor belt to a second elevation measured at an exit of the second conveyor belt.

Another alternate embodiment of a waterslide amusement device formed in accordance with the present invention for entertaining a user includes one or more of a variable speed conveyor belt interfaced with the slide for transporting the user along the predetermined path. The conveyor system may further include a control system having a sensor for sensing the speed of the user along the predetermined path. The control system can be adapted to control the speed of the variable speed conveyor belt based upon the sensed speed of the user.

In yet another alternate embodiment of an amusement device formed in accordance with the present invention for entertaining a user is disclosed. The amusement device includes a slide for supporting and directing the user along a predetermined path and a conveyor system. The conveyor system is coupled to the slide. The conveyor system has a first conveyor belt interfaced with the slide, the first conveyor belt being operable to convey the user at speeds in excess of about 5 ft/sec.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
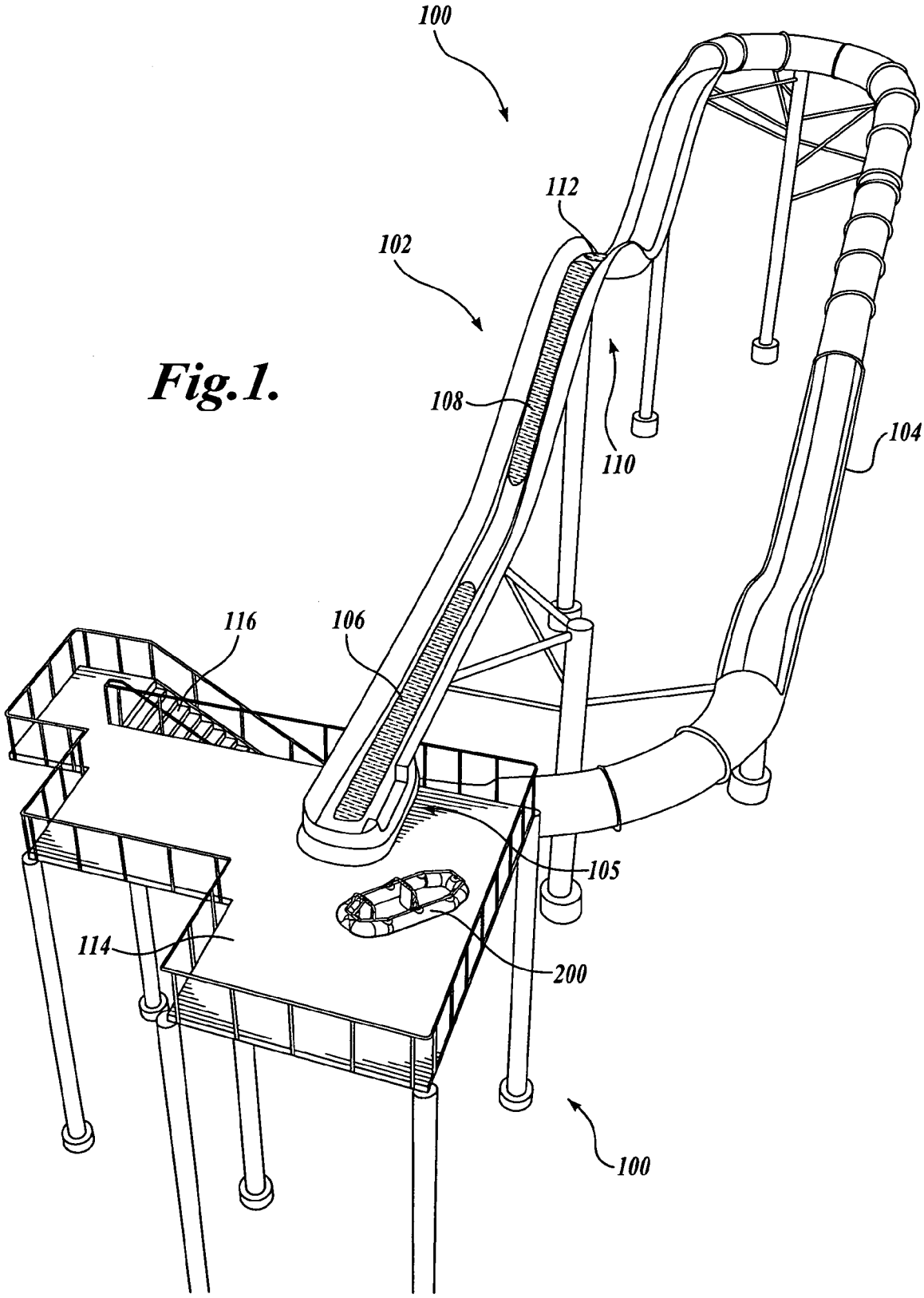
FIG. 1 is a top perspective of one embodiment of a waterslide amusement device formed in accordance with the present invention, the waterslide amusement device having a conveyor system for transporting a user along a waterslide.
Figure 2:
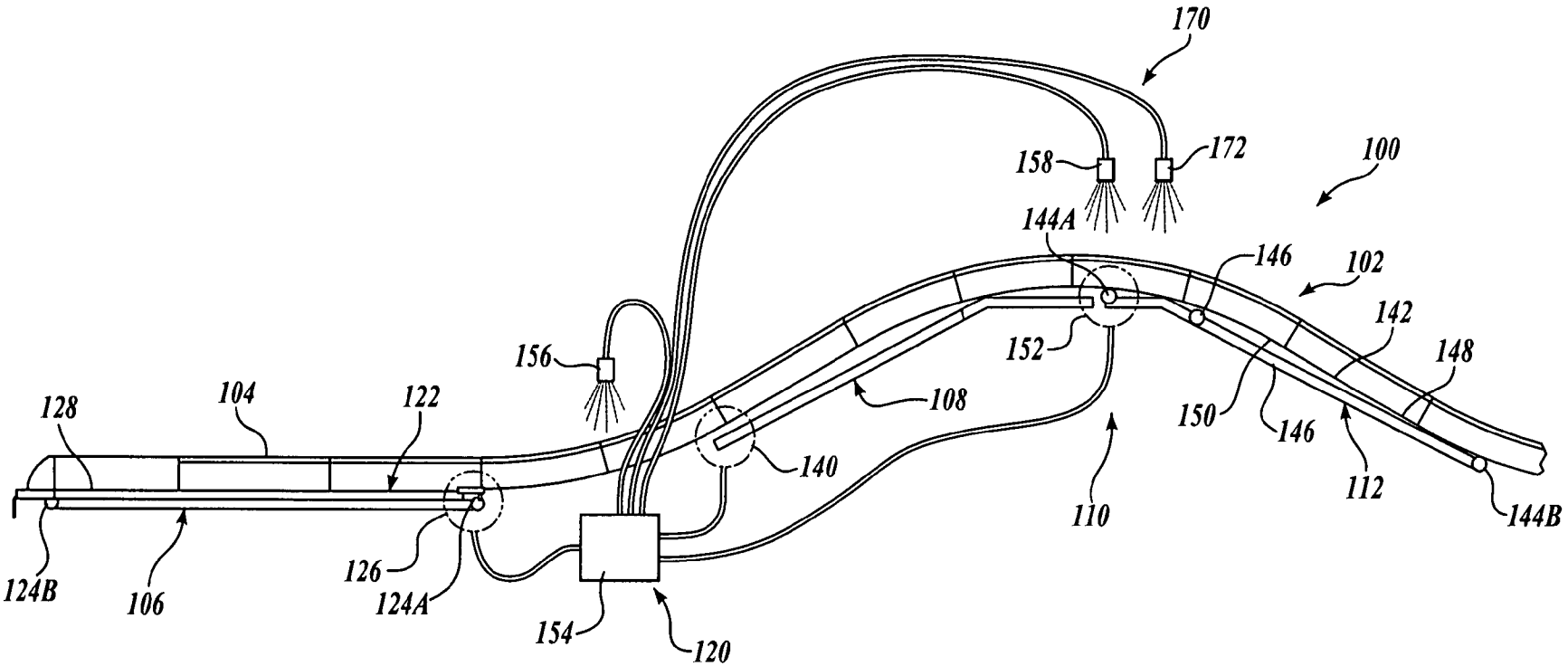
FIG. 2 is a side elevation of a portion of the waterslide amusement device depicted in FIG. 1 showing both an accelerating conveyor assembly, a lift conveyor assembly, and a downhill conveyor assembly.

With reference to FIGS. 1 and 2, a waterslide amusement device 100 formed in accordance with the present invention includes a conveyor system 102 for accelerating a user along a waterslide 104. The conveyor system 102 includes an accelerating conveyor assembly 106 located adjacent to a rider entrance 105, a lift conveyor assembly 108 disposed further along the path of the waterslide 104, and a downhill conveyor assembly 112 following the lift conveyor assembly 108. The accelerating conveyor assembly 106 begins the ride and is used to accelerate a user horizontally. The accelerating conveyor assembly 106 discharges the rider, who is then received by the lift conveyor assembly 108. The lift conveyor assembly 108 accelerates and lifts the rider up a hill 110 and discharges the rider at a crest of the hill 110. At the crest of the hill 110, the rider is received by a downhill conveyor assembly 112, wherein the downhill conveyor assembly 112, with the aid of gravity, propels the rider down the hill 110 and along the remaining length of the waterslide 104.

More specifically referring to FIG. 1, the waterslide amusement device 100 includes an elevated platform 114 accessible by stairs 116. The elevated platform 114 provides rider access to the waterslide 104 for directing a vehicle 200 with a rider (not shown) seated therein and a stream of water along a winding predetermined path defined by the waterslide 104. The vehicle 200 may be any device adapted to support the rider upon the waterslide 104. In one embodiment, the vehicle 200 is an inflatable raft, such as the raft described below with reference to FIGS. 7 and 8. In another embodiment, the vehicle 200 is a flexible mat. In another embodiment, the vehicle 200 is a rigid or semi-rigid boat.

Figure 7:
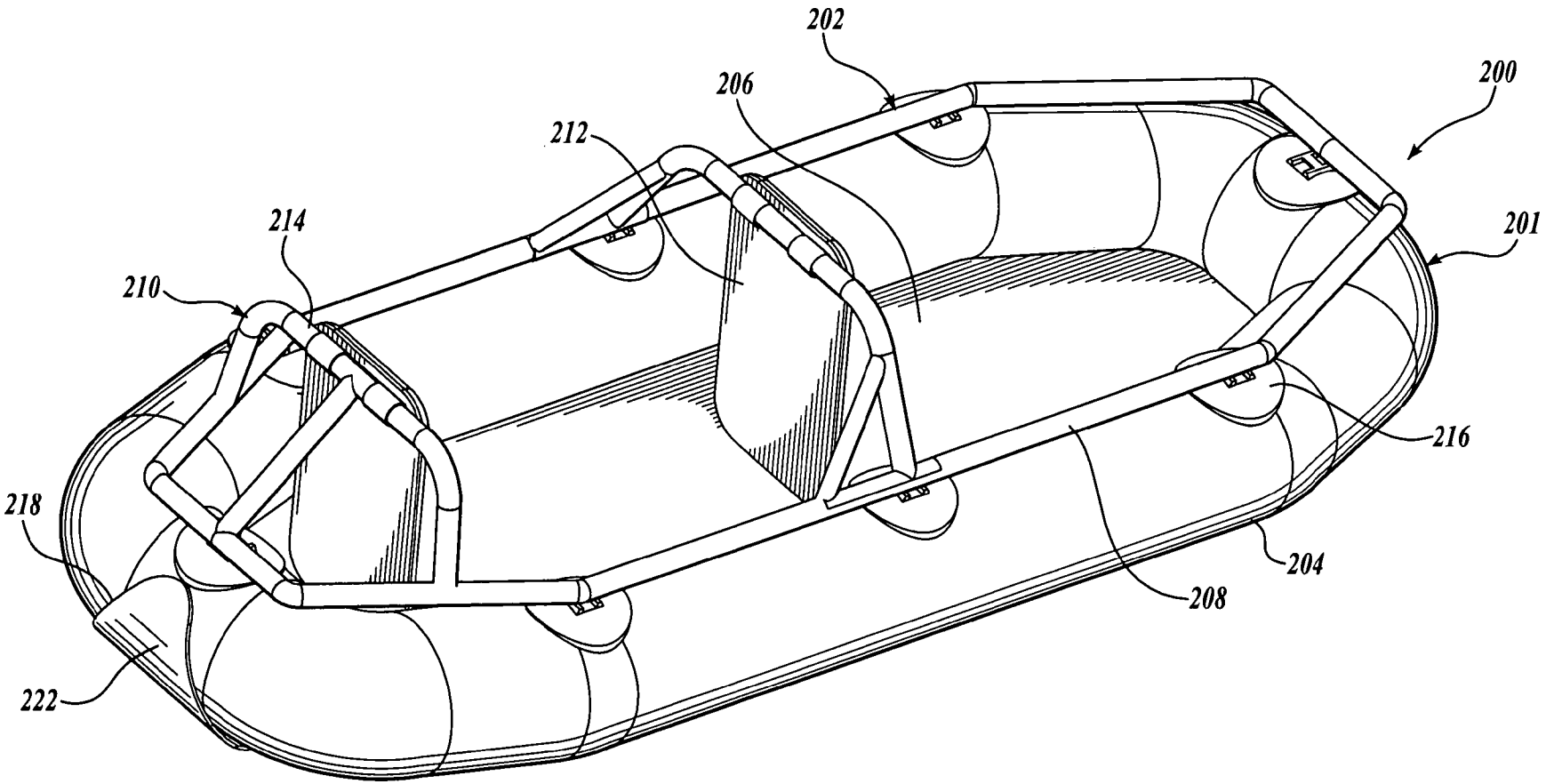
FIG. 7 is a top perspective of a vehicle usable in the embodiment of FIG. 1.

Referring to FIG. 7, the illustrated vehicle 200 includes an inflatable portion 201 and a rigid portion 202. The inflatable portion 201 forms a boat hull for containing the user and providing a flexible, cushioning barrier between the user and the waterslide. The inflatable portion 201 includes an oval shaped main air chamber 204 that is substantially circular in cross section and a planar floor section 206, which may or may not be inflatable. The rigid portion 202 includes a rigid frame 208 disposed above and attached to a top surface of the main air chamber 204. The rigid frame 208 provides rigidity to the inflatable portion 201. The rigid frame 208 is generally oval in shape to match the shape of the main air chamber 204 and is formed from piping bent or otherwise formed into the desired shape. The rigid frame 208 is suspended above the main air chamber 204 a selected distance, which enables a user to grab the rigid frame 208 as a hand hold. The rigid frame 208 is coupled to the main air chamber 204 by a plurality of attachment assemblies 216.

The rigid frame 208 includes a pair of backrest support assemblies 210 for supporting a backrest 212. The backrest support assemblies 210 include a cross member 214 extending across the vehicle 200 between opposing sides of the rigid frame 208. Each backrest 212 is adapted to support a back of a user during the user's use of the vehicle 200.

Figure 8:
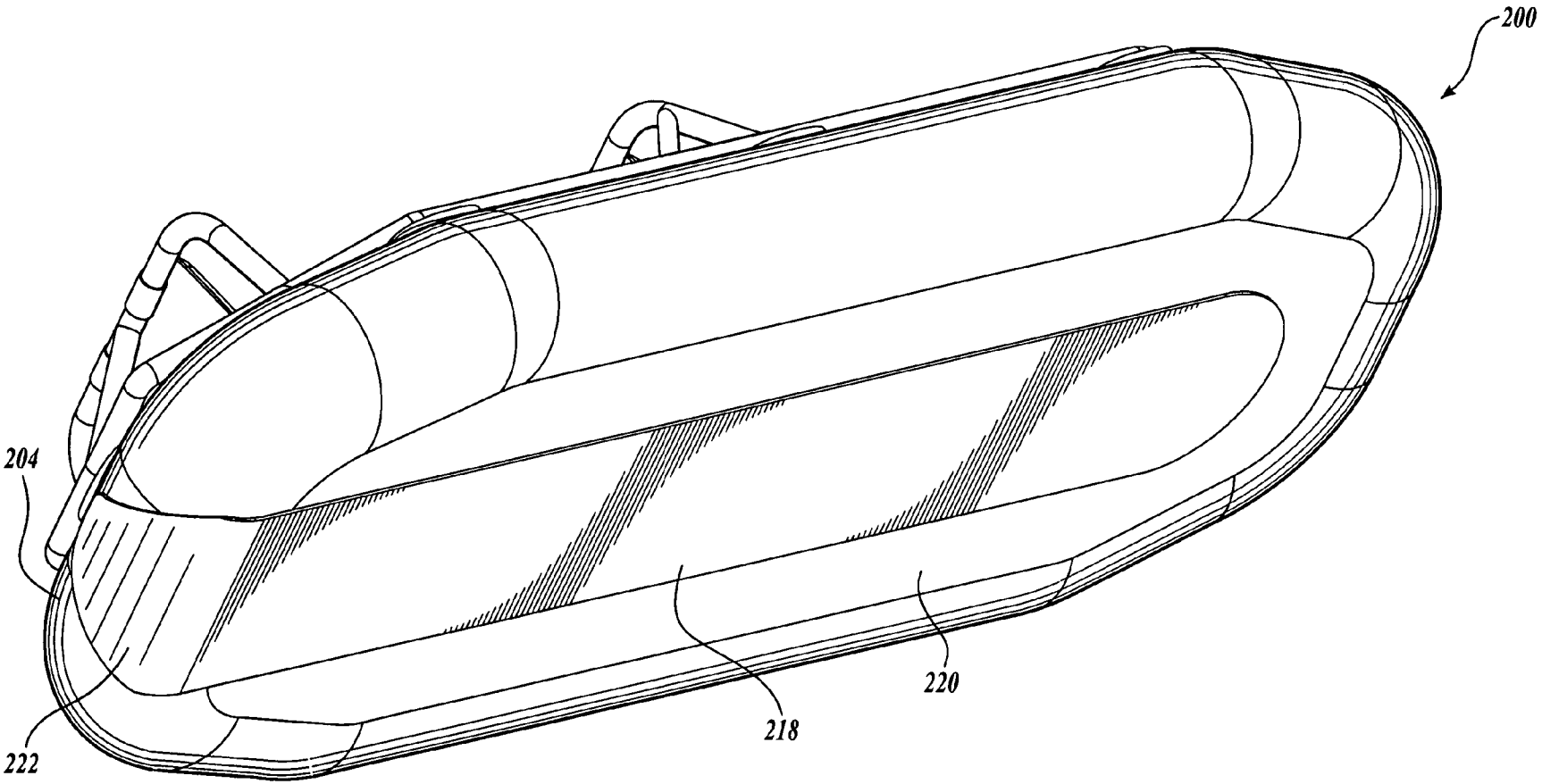
FIG. 8 is a bottom perspective of the vehicle of FIG. 7.

Referring to FIGS. 7 and 8, the vehicle 200 includes an engagement pad 218 coupled to a bottom surface 220 of the vehicle 200. The engagement pad 218 is preferably made of material that is able to protect the bottom surface 220 of the vehicle 200 from excessive wear and damage, and that is able to grip a conveyor belt while being able to slide along the waterslide without substantial friction losses. In the illustrated embodiment, the engagement pad 218 is formed from the same material as the conveyor belt upon which it is designed to interface with. A force transfer portion 222 of the engagement pad 218 wraps up and partially around an aft end of the main air chamber 204. The force transfer portion 222 aids in transferring the tension forces present in the engagement pad 218 during acceleration of the vehicle 200 to the main air chamber 204, thereby impeding the separation of the engagement pad 218 from the vehicle 200.

Figure 3:
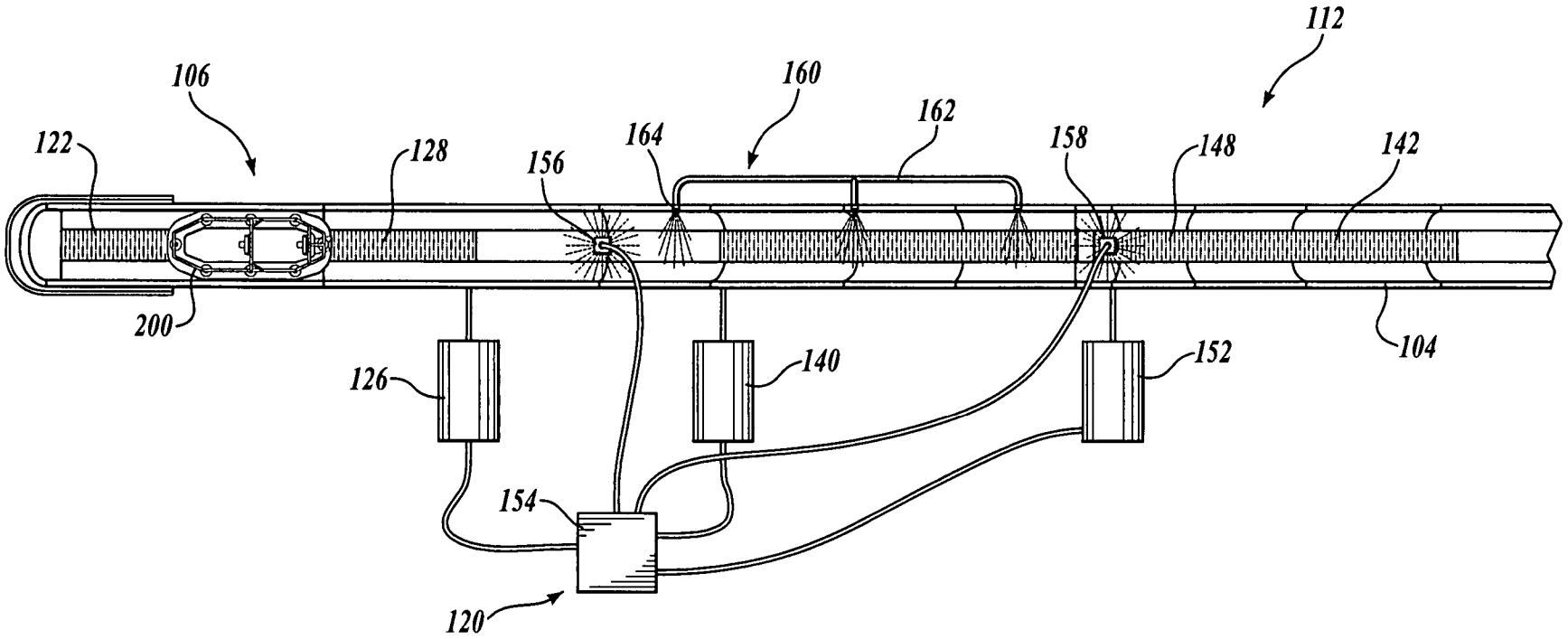
FIG. 3 is a top plan of the portion of the waterslide amusement device shown in FIG. 2.

Turning to FIGS. 2 and 3, the waterslide amusement device 100 includes a conveyor system 102 for aiding in transporting the vehicle and rider along the path of the waterslide 104. As mentioned above, the conveyor system 102 includes one or more of an accelerating conveyor assembly 106, a lift conveyor assembly 108, and a downhill conveyor assembly 112. The waterslide amusement device 100 can also include a control system 120 for controlling the operation of the conveyor assemblies 106, 108, and 112.

Focusing on the accelerating conveyor assembly 106, the accelerating conveyor assembly 106 includes an accelerating conveyor belt 122 disposed about a driven pulley 124A and an idler pulley 124B in an endless loop arrangement. The accelerating conveyor belt 122 may be formed from any suitable material, one example being synthetic rubber. A top surface 128 of the accelerating conveyor belt 122 is exposed at the bottom of the trough of the waterslide 104 for at least partially engaging the vehicle 200 and carrying the vehicle 200 between an entrance end and an exit end of the conveyor belt 122. The top surface 128 (and the vehicle 200 when present on the top surface 128) is supported by a slider bed disposed underneath the top surface 128 such that the upper run of the accelerating conveyor belt 122 is slidingly supported thereon.

The top surface 128 is preferably a high friction surface such that vehicle 200 is carried upon the top surface 128 with little or no slippage and without the need for mechanical linkage between the top surface 128 and the vehicle 200. Alternately, the top surface 128 may be a low friction surface such that vehicle 200 slips upon the top surface 128 and is smoothly accelerated by the friction between the top surface 128 and the vehicle 200 as they slide relative to one another. In another embodiment, the vehicle 200 is mechanically linked to the top surface 128 by any number of suitable means, one suitable example being a hook and bar system. The top surface 128 of the conveyor belt 122 of the illustrated embodiment is oriented substantially horizontally.

The driven pulley 124A is coupled to a drive source 126, such as an electric motor. The drive source 126 is adapted to selectively drive the driven pulley 124A to cause the accelerating conveyor belt 122 to rotate about the pulleys 124A and 124B and thus propel the vehicle and rider along the waterslide 104. The drive source 126 may be sized and selectively controlled to accelerate the vehicle and rider at an average rate of between about 0 G-force (0 ft/sec$^2$) to about 1 G-force (32.2 ft/sec$^2$) or higher, such as 2 G-force, with a preferred acceleration rate of about 0.75 G-force (24 ft/sec$^2$). In one embodiment, the accelerating conveyor assembly 106 is operable to accelerate the vehicle 200 and rider from a speed of about 0 ft/sec to a speed of about 30 ft/sec or higher, such as 50 ft/sec, in a length of about 27 feet in approximately 1.5 seconds, applying an average G-force of approximately 0.75 upon the vehicle and rider.

Figure 4:
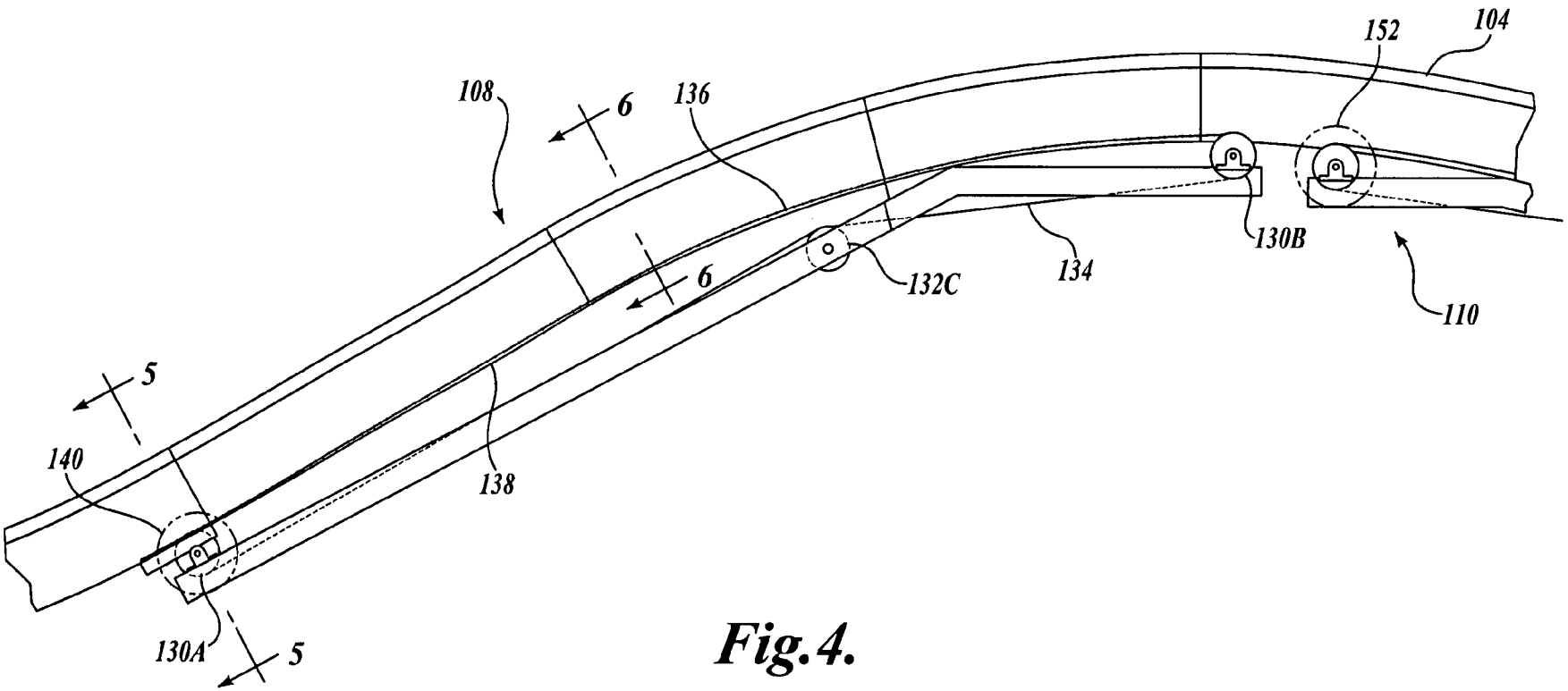
FIG. 4 is an enlarged fragmentary elevation of the lift conveyor assembly of FIGS. 1-3.
Figure 5:
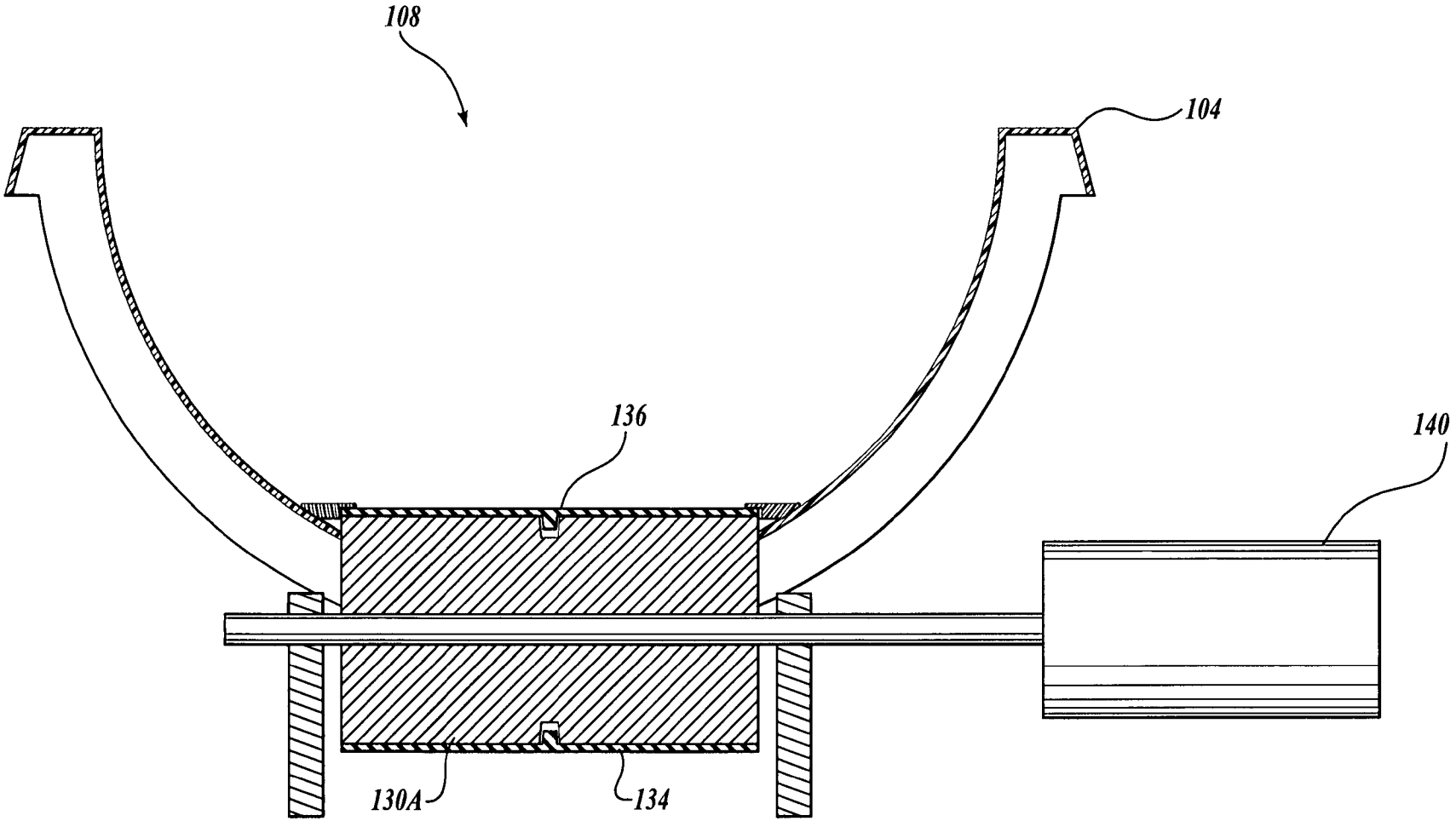
FIG. 5 is a section along line 5-5 of FIG. 4.

Turning to FIGS. 4 and 5 and focusing upon the lift conveyor assembly 108, the lift conveyor assembly 108 includes a lift conveyor belt 134 disposed about a driven pulley 130A and an idler pulley 130B in an endless loop arrangement. A tensioner pulley 132C presses against the lift conveyor belt 134 to tension the lift conveyor belt 134. The lift conveyor belt 134 may be formed from any suitable material, one example being synthetic rubber. A top surface 136 of the lift conveyor belt 134 is exposed at the bottom of the trough of the waterslide 104 for at least partially engaging and carrying the vehicle 200. The top surface 136 is supported by an arcuate shaped slider bed or support plate 138 which in the illustrated embodiment is generally convex in shape. The convex shape of the support plate 138 in turn imparts a corresponding convex shape to the upper run of the belt and its top surface 136. Thus, when the vehicle and rider are transported along the waterslide 104 of the illustrated embodiment by the lift conveyor belt 134, the vehicle and rider are conveyed along an arcuate path of approximately 25.5 feet in length with an elevation change of approximately nine feet.

The driven pulley 130A is coupled to a drive source 140, such as an electric motor. The drive source 140 is adapted to selectively drive the driven pulley 130A to cause the lift conveyor belt 134 to rotate about the pulleys 130A and 130B and thus propel the vehicle and rider along the waterslide 104. The drive source 140 may be sized and selectively controlled to accelerate the vehicle and rider up the hill 110 such that at the crest of the hill 110, the vehicle and rider are returned to the exit speed (30 ft/sec) of the accelerating conveyor assembly (because of friction between the vehicle and the slide surface, the vehicle and rider lose some speed between exiting the accelerating conveyor belt and entering the lift conveyor belt 134). In one embodiment, the lift conveyor system 108 is operable to accelerate the vehicle 200 and rider from a speed of about 25 ft/sec to a speed of about 30 ft/sec or even higher, such as 50 ft/sec, in a length of about 25.5 feet in approximately 1 second, while elevating the vehicle and rider approximately nine feet.

Referring to FIG. 3, the waterslide amusement device 100 may include a water mist system 160. The water mist system 160 includes a piping system 162 for providing pressurized water to one or more nozzles 164. The water exits the nozzles 164 as a fine mist. The mist may serve several purposes, such as visually blocking the rider's view of the lift conveyor assembly 108 such that the riders cannot anticipate the lift conveyor assembly 108, increasing the entertainment value of the ride. Further, the mist may be used to cool the riders and/or decrease friction between the waterslide 104 and vehicle.

Although the water mist system 160 is illustrated and described as being used in a specific area of the waterslide, it should be apparent to those skilled in the art that other arrangements and locations of the water mist system 160 are suitable for use with and are within the spirit and scope of the present invention, including water mist systems 160 located along the entire length of the waterslide or any portion thereof. Of note, the water mist system 160 is only depicted in FIG. 3 in order simplify and clarify the other figures.

Referring to FIG. 2, the waterslide amusement device 100 may include an entertainment system 170. The entertainment system 170 includes an effect emitter 172, which may be a speaker, a light, a pyrotechnic device, a water spray nozzle, an actuator, etc. suitable for use in emitting any suitable entertainment effect for entertaining the user, a few suitable examples being sound, light, fog, blast of air, smells, water streams, etc., from the effect emitter 172, or alternately cause movement of an object, such as movement of a fake wall out of the path of the vehicle at the last movement, by the use of an actuator.

Preferably the entertainment system 170 includes a sensor 158 for sensing the presence of the vehicle such that the emittance of the entertainment effect from the effect emitter 172 may be tied to the presence of the vehicle. Thus, the emittance of the entertainment effect can be timed for maximum effect. The entertainment system 170 may be a stand alone system or the entertainment system 170 may be coupled in signal communication with a controller 154 of the control system 120 and therefore may use the speed sensors 156 and 158 of the control system 120 to detect or estimate the presence of the vehicle for purposes of timing the emittance of the entertainment effect from the effect emitter 172. The sensors 156 and 158 may be any suitable sensor capable of detecting the presence or absence of the vehicle, a few suitable examples being infrared motion detectors, mechanical switches, etc. The control system 120, controller 154, and speed sensors 156 and 158 are discussed in more detail below.

Although the entertainment system 170 is illustrated and described as being used in a specific area of the waterslide 104, it should be apparent to those skilled in the art that other arrangements and locations of the entertainment system 170 are suitable for use with and are within the spirit and scope of the present invention, including entertainment systems 170 located along the entire length of the waterslide or any portion thereof. Of note, the entertainment system 170 is only depicted in FIG. 2 in order simplify and clarify the other figures.

Turning to FIGS. 2 and 3 and focusing upon the downhill conveyor assembly 112, the downhill conveyor assembly 112 is substantially a mirror image of the lift conveyor assembly 108, with the exception that the direction of travel of the conveyor belt is reversed. The downhill conveyor assembly 112 includes a downhill conveyor belt 142 disposed about a driven pulley 144A and an idler pulley 144B in an endless loop arrangement. A tensioner pulley 146 presses against the downhill conveyor belt 142 to tension the downhill conveyor belt 142. The downhill conveyor belt 142 may be formed from any suitable material, one example being synthetic rubber. A top surface 148 of the downhill conveyor belt 142 is exposed at the bottom of the trough of the waterslide 104 for at least partially engaging and carrying the vehicle 200. The top surface 148 is supported by an arcuate shaped slider bed or support plate 150, which in turn imparts an arcuate shape to the top surface 148. Thus, when the vehicle and rider are transported along the waterslide 104 of the illustrated embodiment by the downhill conveyor belt 142, the vehicle and rider are conveyed along an arcuate path substantially convex in shape of approximately 25.5 feet in length with an elevation change downward of approximately nine feet.

The driven pulley 144A is coupled to a drive source 152, such as an electric motor. The drive source 152 is adapted to selectively drive the driven pulley 144A at variable speeds to cause the downhill conveyor belt 142 to rotate about the pulleys 144A and 144B and thus propel the vehicle and rider along the waterslide 104. The drive source 152 may be sized to accelerate the vehicle and rider along the downward side of hill 110, complimenting the force of gravity. Alternately, the drive source 152 may be used as a brake to decelerate the vehicle and the rider, to impede the build-up of excess speed or to provide a thrilling braking experience.

A control system 120 for the conveyors can include a controller 154 coupled in signal communication with the drive sources 126, 140, and 152. The controller 154 is adapted to selectively control the speed and power output of each of the drive sources 126, 140, and 152 to selectively control the passage of the vehicle along the waterslide 104.

In the illustrated embodiment, the controller 154 is coupled in signal communication with a plurality of speed sensors 156 and 158 for sensing the speed of the vehicle as the vehicle passes the speed sensor 156 or 158. The speed sensors 156 and 158 may be well known thru-beam photo electric eyes. The speed sensors 156 and 158 are adapted to report a speed of the vehicle to the controller 154, such that the controller 154 can selectively control the speed of the lift conveyor belt 134 and down hill conveyor belt 142 relative to the sensed speed of the vehicle 200. For instance, the controller 154 may control the speed of the lift conveyor belt 134 and/or down hill conveyor belt 142 to match the speed of the vehicle as the vehicle first engages the conveyor belt 134 or 142, thereby providing a smooth transition for the vehicle to the conveyor belt 134 or 142, and thereafter selectively accelerate, decelerate, and/or maintain the speed of the conveyor belt as the needs of the ride require.

The waterslide amusement device 100 further includes a well known water flow system (not shown) for providing a stream or misting of water along the length of the waterslide 104 to reduce the friction between the vehicle and the waterslide 104 and to enhance the entertainment value of the ride. Inasmuch as such systems are well known in the art, the water flow system of the illustrated embodiment will not be further described herein.

Figure 6:
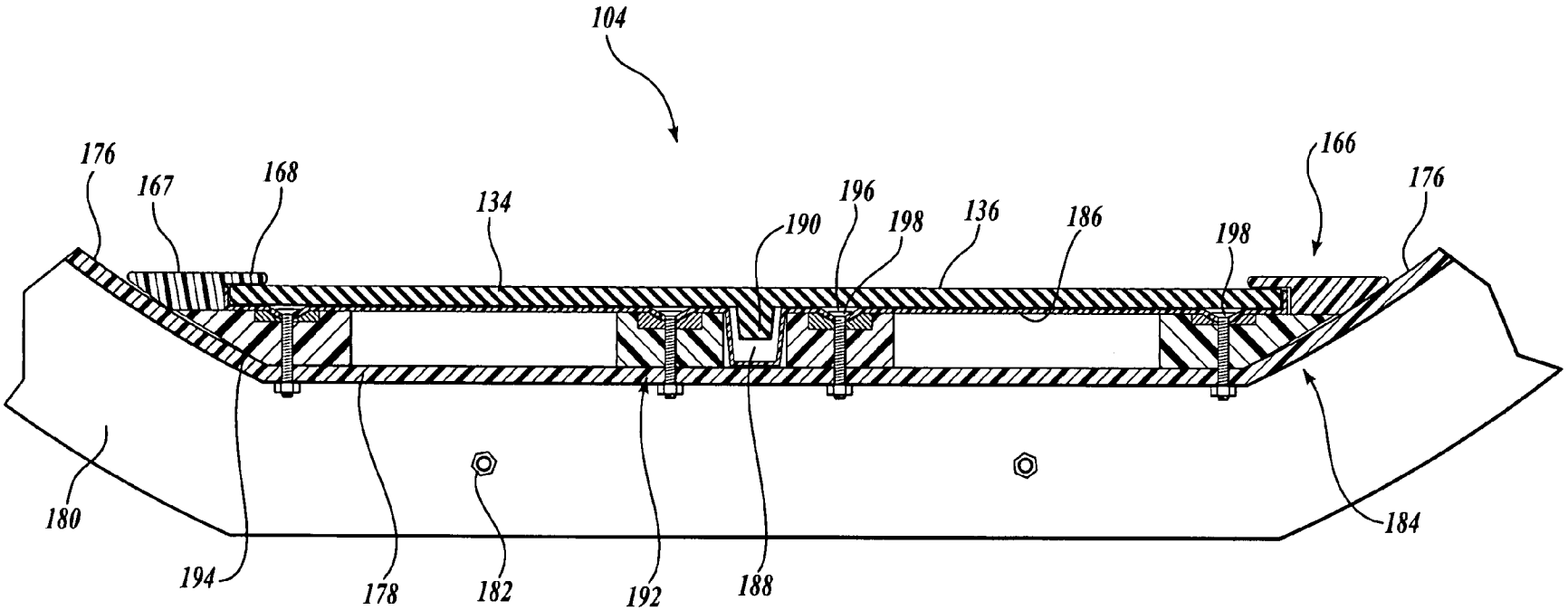
FIG. 6 is a section along line 6-6 of FIG. 4.

Referring to FIG. 6, this detailed description will now focus upon the waterslide 104. The waterslide 104 is preferably of a flume configuration having opposing sidewalls 176 which curve upward from a bottom wall 178 to aid in containing the vehicle and water flowing along the waterslide 104 contained therein. Each section of the waterslide 104 terminates in a flange 180 at their respective ends, adjacent flanges 180 being coupled to one another by a plurality of fasteners 182 to couple adjacent sections to one another.

The waterslide 104 includes a slide assembly 184. The slide assembly 184 includes a slider bed 186 made of any suitable rigid or semi-rigid material having a low coefficient of friction, one suitable example being stainless steel. The slider bed 186 supports the lift conveyor belt 134 while providing a slide surface for the lift conveyor belt 134 to slide upon during use. The slider bed 186 includes an elongate channel 188 extending longitudinally down the centerline of the slider bed 186. The elongate channel 188 is sized and configured to receive an elongate guide member 190 coupled along the longitudinal centerline of the lift conveyor belt 134. In one working embodiment, the guide member 190 is a well known V-belt adhered to the lift conveyor belt 134, however, those skilled in the art will appreciate that the guide member 190 may be located in alternate locations and be made from alternate materials.

The slider bed 186 is partially supported by a slider frame 192 having series of elongate frame members 194 disposed longitudinally along the length of the waterslide 104 underneath the slider bed 186. Each of the elongate frame members 194 include an elongate recess 196 disposed along each of the elongate frame members 194. The elongate recesses 196 are configured to permit the slider bed 186 to be deformed so as to enter the elongate recess 196. This permits a head 198 of a fastener to be recessed within the elongate recess 196 such that the head 198 of the fastener does not contact the lift conveyor belt 134 during use after the slider bed 186 is coupled to the elongate frame members 194.

The waterslide 104 further includes an edge guard assembly 166 comprising of a pair of edge guards 167 disposed along the edges of the lift conveyor belt 134. The edge guards 167 have a safety extension 168 which extends a selected distance inward from a side of the lift conveyor belt 134 to overlap a portion of the top surface 136 of the lift conveyor belt 134. The safety extensions 168 impede an object, such as a user's clothing or appendages, from being caught by the edges of the lift conveyor belt 134.

In light of the above description of the structure of the waterslide amusement device 100, the operation of the waterslide amusement device will now be described. Referring to FIGS. 1-3, during operation, a rider carries a vehicle 200 up the stairs 116 to the elevated platform 114. In an alternate embodiment not shown, the waterslide entrance maybe at grade, so that the rider may enter without climbing stairs to a platform. The accelerating conveyor belt 122 is brought to a stop by the controller 154 to aid in rider loading. The rider places the vehicle 200 upon the accelerating conveyor belt 122 and boards the vehicle. An operator starts the ride by operating a control to accelerate the accelerating conveyor belt 122, increasing the speed of the vehicle 200 from about 0 ft/sec at an entrance of the accelerating conveyor belt 122 to about 30 ft/sec at an exit of the accelerating conveyor belt 122, thus exposing the vehicle 200 and rider to approximately an exhilarating 0.75 G-force. The controller 154 may then bring the accelerating conveyor belt 122 to a stop to aid in the loading of the next rider.

After exiting the accelerating conveyor belt 122, the vehicle 200 slides along the portion of the waterslide 104 disposed between the exit of the accelerating conveyor belt 122 and the entrance of the lift conveyor belt 134. While vehicle 200 is sliding between conveyor belts 122 and 134, the first speed sensor 156 senses the speed of vehicle 200 and relays the sensed speed to the controller 154. The controller 154 adjusts the speed of the lift conveyor belt 134 to substantially match the sensed speed so that the vehicle may smoothly transition to the lift conveyor belt 134. Rider weight, water volume, and friction coefficients will affect the deceleration of the rider and vehicle on the slide. Suppose, for example, that after exiting the accelerating conveyor belt 122, the vehicle slows to about 25 ft/sec due to friction and due to a slight upward elevation change in the waterslide 104. The controller 154 controls the speed of the lift conveyor belt 134 to be at a speed substantially matching that of the vehicle as the vehicle enters the lift conveyor belt 134 (i.e., about 25 ft/sec). The vehicle is then accelerated and elevated as the vehicle travels up the hill 110. In the illustrated embodiment, the vehicle is elevated approximately nine feet and is accelerated to have an exit speed of about 30 ft/sec.

The vehicle is then discharged from the lift conveyor belt 134 and slides along the portion of the waterslide 104 disposed between the exit of the lift conveyor belt 134 and the entrance of the downhill conveyor belt 142. While sliding between conveyor belts 134 and 142, the second speed sensor 158 senses the speed of the vehicle and relays the sensed speed to the controller 154. The controller 154 adjusts the speed of the downhill conveyor belt 142 to match the sensed speed so that the vehicle may smoothly transition to the entrance of the downhill conveyor belt 142. That is, the controller 154 controls the speed of the downhill conveyor belt 142 to be at a speed substantially matching the speed of the vehicle as it enters the downhill conveyor belt 142. Depending upon the desired experience, the vehicle is then accelerated, decelerated, or maintained in speed as the vehicle travels down the downward side of hill 110. The vehicle travels down the path of the waterslide 104 until the end of the ride, wherein the rider dismounts and removes the vehicle.

The entertainment system 170 may discharge entertainment effects during operation of the waterslide amusement device 100 to enhance the entertainment value of the ride. Likewise, the water mist system 160 may be used to visual block the rider's view of upcoming events, to cool the riders, and/or decrease friction between the waterslide 104 and vehicle 200 during operation of the waterslide amusement device 100.

Figure 9:
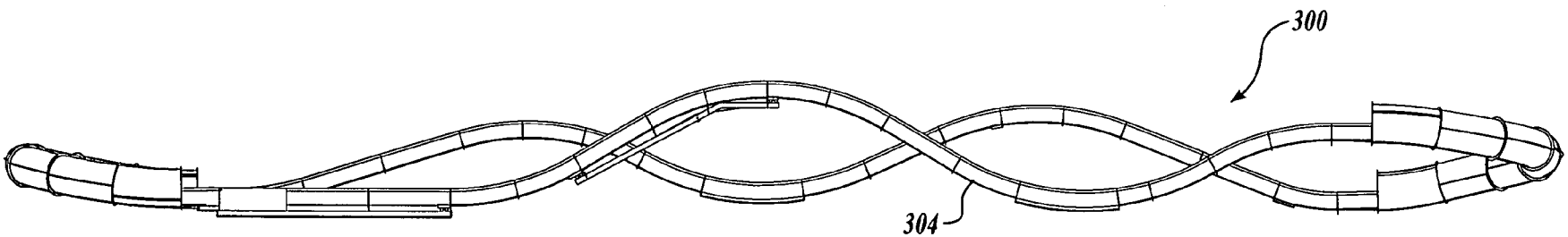
FIG. 9 is an elevation of an alternate embodiment of a waterslide amusement device formed in accordance with the present invention, the waterslide amusement device configured in a continuous loop arrangement.

An alternate embodiment of a waterslide amusement device 300 formed in accordance with the present invention is shown in FIG. 9. The waterslide amusement device 300 is substantially similar to the above described waterslide amusement device of FIGS. 1-8 in construction and operation. Therefore, for the sake of brevity, this detailed description will focus only upon those aspects of the waterslide amusement device 300 which departs from the above described embodiment.

More specifically, the waterslide amusement device 300 of FIG. 9 is similar in all aspects to the previously described embodiment with exception that the waterslide amusement device 300 is configured in a continuous loop arrangement.

Moreover, the waterslide amusement device of FIGS. 1-8 is illustrated and described as having a waterslide which has a start and an ending portion which are separate from one another. In the waterslide amusement device 300 of FIG. 9, a waterslide 304 of the waterslide amusement device 300 is configured in a continuous loop arrangement such that the waterslide 304 ends back at the same place as the start, making possible multiple lap rides without the user having to exit the waterslide 304, thereby providing enhanced rider load/unload management.

While the preferred embodiment of the invention has been illustrated and described, it will be appreciated that various changes can be made therein without departing from the spirit and scope of the invention.

For instance, although specific acceleration rates, speeds, and distances are described herein for illustrative purposes, those skilled in the art should appreciate that other rates of acceleration, speeds, and distances are suitable for use with the present invention.

As another example, although the illustrated and described embodiment describes a specific arrangement of a conveyor system with includes an accelerating conveyor assembly, followed by a lift conveyor assembly and a downhill conveyor assembly, it should be apparent to those skilled in the art that this represents an illustrative, non-limiting example only and that other arrangements are suitable for use with the present invention. One suitable example of an alternate configuration of a conveyor system includes a conveyor system having any combination of two or more types of conveyor assemblies, disposed in any order relative to one another, and having any number of quantities of conveyor assemblies. A second suitable example of an alternate configuration of a conveyor system includes a conveyor system having any quantity, including one, of only one type of conveyor assembly.

As still another example, although the illustrated and described embodiment describes the use of an accelerating conveyor assembly for initially accelerating the rider and vehicle, it should be apparent to those skilled in the art that this represents an illustrative, non-limiting example only and that other arrangements are suitable for use with the present invention, one suitable example being a waterslide amusement device using a well known vertical drop to accelerate the rider and vehicle.

As an additional example, although the illustrated and described embodiment describes the use of a conveyor system utilizing conveyor belts in which the top run penetrates the waterslide to support the rider and vehicle while the bottom run and the majority of the components of the conveyor belt assembly are disposed below the waterslide, it should be apparent to those skilled in the art that this represents an illustrative, non-limiting example only and that other arrangements are suitable for use with the present invention. For instance, one suitable example of an alternate configuration of a conveyor system is one in which the conveyor assembly is substantially entirely located within the trough of the waterslide. In another suitable example, the waterslide is discontinued and the conveyor assembly is shaped to match up geometrically with the shape of the waterslide to carry the rider and vehicle along the waterslide amusement device.

In another additional example, although the illustrated and described lift conveyor assembly describes the use of variable speed conveyor assemblies operable to accelerate the rider and vehicle, it should be apparent to those skilled in the art that this represents an illustrative, non-limiting example only and that other arrangements are suitable for use with the present invention, one suitable example being conveyor assemblies which convey the rider and vehicle at a substantially constant speed. Preferably the speed of such a substantially constant speed conveyor assembly exceeds about 3 ft/sec so as to provide an exhilarating ride, with a preferred speed exceeding about 10 ft/sec and including speeds up to and exceeding 50 ft/sec.

The embodiments of the invention in which an exclusive property or privilege is claimed are defined as follows:

1. A waterslide amusement device for entertaining a first user and a second user consecutively, said device comprising:

(a) a waterslide for supporting and directing a user;

(b) a conveyor system coupled to the slide, the conveyor system having a first variable speed conveyor belt interfaced with the slide and extending therealong, the first conveyor belt having an entrance portion at an end thereof for receiving the first user onto the first conveyor belt and an exit portion at the opposite end thereof for discharge of the first user from the first conveyor belt; and (c) a first control system constructed and arranged to increase the speed of the first conveyor belt with the first user thereon from a starting or launch speed of substantially zero to a fast moving second speed as the first user travels from the entrance portion to the exit portion of the first conveyor belt, the control system being constructed and arranged to automatically return the first conveyor belt to a speed of substantially zero after the first user is discharged from the first conveyor belt so as to be in position for loading the second user on the entrance portion of the first conveyor belt followed by acceleration and discharge thereof.

2. The waterslide amusement device of claim 1, wherein the first conveyor belt is oriented substantially horizontally.

3. The waterslide amusement device of claim 1, wherein the exit speed of the first user is equal to or greater than about 20 feet per second.

4. The waterslide amusement device of claim 1, in which the conveyor system includes a second variable speed conveyor belt located downstream from the exit portion of the first conveyor belt, the second conveyor belt having an entrance portion adapted to receive each user after discharge from the first conveyor belt and an exit portion at the opposite end of the second conveyor belt from the entrance portion, and a second control system constructed and arranged to control the second conveyor belt to accelerate each user from the entrance portion thereof to the exit portion thereof, the control system including a sensor for detecting the speed of each user as such user approaches the entrance portion of the second conveyor belt and for adjusting the speed of the second conveyor belt as a function of the detected speed, followed by acceleration of the speed of the conveyor belt as such user moves therealong.

5. The waterslide amusement device of claim 4, in which the second control system adjusts the speed of the second conveyor belt to approximately match the speed of each user as such user approaches the entrance of the second conveyor belt for a smooth entry of such user onto the second conveyor belt.

6. The waterslide amusement device of claim 4, in which at least one of the control systems accelerates one of the conveyor belts and each user thereon at an average acceleration of at least about 7 ft/sec$^2$.

7. The waterslide amusement device of claim 4, wherein at least one of the control systems accelerates one of the conveyor belts at an average acceleration of at least about 20 ft/sec$^2$.

8. The waterslide amusement device of claim 4, wherein at least one of the control systems accelerates one of the conveyor belts at an acceleration of at least about 0.75 G-force.

9. The waterslide amusement device of claim 1, further comprising a vehicle adapted to be driven by the first conveyor belt along the slide while carrying a user, wherein the vehicle includes an inflatable portion and a rigid portion for stiffening the inflatable portion.

10. The waterslide amusement device of claim 9, wherein a backrest is coupled to the rigid portion for supporting a back of a user during acceleration.

11. The waterslide amusement device of claim 9, wherein the vehicle further includes an engagement pad disposed between the inflatable portion and the slide, the engagement pad being wear resistant material and adapted to engage the first conveyor belt.

12. A waterslide amusement device for entertaining a user comprising:

(a) a waterslide for supporting and directing the user while moving therealong; and (b) a conveyor system coupled to the slide, the conveyor system including:

(i) a variable speed conveyor belt interfaced with the slide for transporting the user along the waterslide from an entrance portion of the belt to and off an exit portion of the belt; and (ii) a control system having a sensor for sensing the speed of the user at a preselected location adjacent to the entrance portion, the control system being constructed and arranged to automatically control the speed of the variable speed conveyor belt based on the sensed speed of the user for a smooth transition of the user onto the entrance portion and thereafter to automatically accelerate the belt to a much faster speed for acceleration of the user to and off the discharge portion followed by slowing the belt to a speed based on the detected speed of approach of a subsequent user.

13. The waterslide amusement device of claim 12, wherein the control system controls the speed of the variable speed conveyor belt to substantially match the speed of the user entering the entrance portion of the variable speed conveyor belt.

14. The waterslide amusement device of claim 12, wherein the variable speed conveyor belt is oriented substantially horizontally.

15. The waterslide amusement device of claim 12, wherein the control system controls the variable speed conveyor belt to accelerate the user at an average rate of at least about 7 $ft/sec^2$.

16. The waterslide amusement device of claim 12, wherein the control system controls the variable speed conveyor belt to accelerate the user at an average rate of at least about 20 $ft/sec^2$.

17. The waterslide amusement device of claim 12, wherein the control system controls the variable speed conveyor belt to accelerate the user at an average rate of at least about 0.75 G-force.

* * * * *